United States Patent [19]

Matsumoto

[11] 4,022,458

[45] May 10, 1977

[54] SHEET DISTRIBUTION APPARATUS

[75] Inventor: Osamu Matsumoto, Ebina, Japan

[73] Assignee: Rank Xerox Ltd., London, England

[22] Filed: June 22, 1976

[21] Appl. No.: 698,653

[30] Foreign Application Priority Data

Sept. 22, 1975 Japan ..... 50-128936

[52] U.S. Cl. ..... 271/173

[51] Int. Cl.[2] ..... B65H 39/10

[58] Field of Search ..... 271/64, 173, 174, 73, 271/189; 270/58; 93/93 R, 93 DP

[56] References Cited

UNITED STATES PATENTS 3,411,773 11/1968 Cornwall ..... 271/73

3,685,819 8/1972 Deutsch ..... 271/173

*Primary Examiner*—Richard A. Schacher

*Attorney, Agent, or Firm*—James J. Ralabate; Michael H. Shanahan; Paul Weinstein

[57] ABSTRACT

A sheet distribution apparatus for distributing sheets discharged from a reproducing machine. An improved apparatus sequentially distributes sheets into a plurality of bins comprising sheet receiving shelves arranged in a horizontal array. A guide belt is arranged to receive the discharged sheets and guide them into the respective shelves. The guide belt is coiled upon a take-up reel at one end at its other end a device is provided for sequentially advancing the belt along the entrance openings of the bins to distribute the sheets into the respective bins.

6 Claims, 2 Drawing Figures

SHEET DISTRIBUTION APPARATUS

BACKGROUND OF THE INVENTION

This invention relates to a sheet distribution device or sorter for distributing sheets in association with a printing press, a copier, or the like.

In one type of sheet distribution device conventionally used every sheet-receiving shelf or bin in the sorter bin array is provided with a guide roller and a guide pawl for sequentially delivering the sheets to the respective bins. As a result the number of guide rollers and guide pawls is large which results in a large and complicated sorter design with a propensity for being noisy and unreliable.

In accordance with another sorting approach known in the art a guide pawl or deflection finger for guiding a sheet into the respective bins is arranged to move sequentially adjacent each of the bins. The deflection finger is carried by a belt as set forth, for example, in U.S. Pat. Nos. 3,604,321, to Snellman, and 3,685,819, to Deutsch. In the latter patent a web-type conveyor associated with the deflection finger is used to convey the sheets to the sheet receiving shelves.

SUMMARY OF THE INVENTION

The present invention has as its object the provision of a sheet distribution device or sorter which can distribute sheets without the use of guide rollers and guide pawls.

This is acheived by means of a guide belt which is wound about a take-up roller. The take-up roller is spring biased in a direction so as to wind the belt about the roller. The free end of the belt is secured to a movable guide associated with the receiving shelves or bins of the sorter. The guide has wheels attached at its extremities which are arranged to ride in rails supported at the bin entrance openings. A cable drive system is utilized to increment the guide along the plane of the sorter bin openings so that sheets can be sequentially fed into the sorter bin. As the guide is sequentially incremented the guide belt is unwound from the take-up roller. Preferably the guide belt includes a low friction surface so that documents delivered onto the guide belt will easily slide down the belt and onto the respective receiving shelf.

DETAILED DESCRIPTION OF THE PREFERRED EMBODIMENTS

Figure 1:
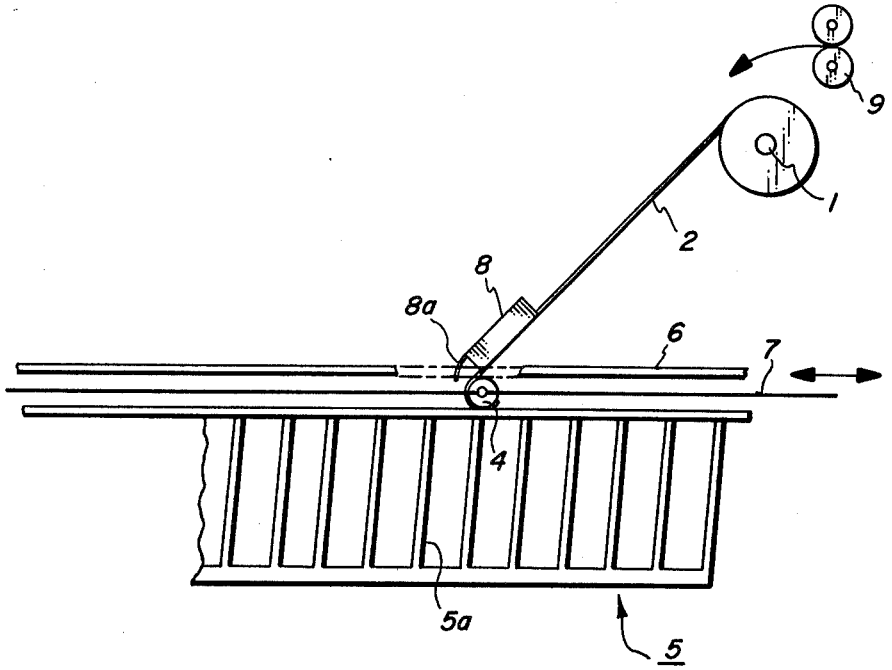
FIG. 1 is a front view of a sheet distributing device in accordance with the present invention.

In accordance with the present invention a sheet-receiving body 5 which includes a plurality of sheet-receiving shelves 5A is provided. The sheet receiving shelves 5A define respective bins of the sheet-receiving device. The bins arearranged in a generally horizontal array with the sheet-receiving shelves 5A parallel to one another. Guide rails 6 are disposed on opposite sides of the sheet-receiving body 5 in the plane of the bin entrance openings for the respective shelves 5A.

One end of a guide belt 2 is wound up upon a take-up roller 1. The take up roller is urged to be rotated by means of a spring of conventional design (not shown)

in a direction which would wind up the guide belt 2 upon the roll 1. The other end of the guide belt is mounted to a shaft 3. The shaft 3 has a pair of wheels 4 which are arranged to roll within the guide rail 6 disposed on the opposite sides of the receiving body 5. A wire 7 is affixed to an end 3A projecting from the wheel 4 on the shaft 3 to provide driving engagement to the shaft. The wire is incrementally advanced so that sheets can be sequentially distributed into the respective sheets receiving shelves. Any desired conventional means, for example, the drive systems set forth for the deflection gate or finger of the above identified patents to Snellman and Deutsch could be employed for incrementally advancing the wire 7. After the last sheet has been fed into its desired shelf the guide belt is rewound upon the roll 1 with the resulting reciprocation to the starting position for the other end of the belt secured to the shaft 3.

A guide cover 8 is provided at the end of the guide belt 2 adjacent ot the bin entrance openings to prevent sheets from falling off the guide belt and to properly guide the sheets into the respective receiving shelves 5A which make up the receiving body 5. The curved portion 8A of the cover 8 serves to guide the sheets into the respective shelves.

Preferably, a Teflon coating is applied to the surface of the guide belt 2 to provide a low friction surface which will enable the sheets to easily slide down the belt into a bin.

In operation, a sheet fed from a printing press or the like is fed onto the guide belt 2 by means of paper discharge rollers 9. The sheet slides down the guide belt 2 and is then dropped into the respective sheet-receiving shelf 5A. The sheet is guided by the curved portion 8A of the cover 8 so that it is properly dropped into and accommodated by the receiving shelf. After a sheet is delivered into one of the shelves the end of the guide belt secured to the shaft 3 is advanced to the bin entrance opening of the next adjacent receiving shelf 5A, by means of the cable 7 being incrementally advanced every time a sheet is fed from the paper discharge rollers 9. Thereby the sheets are sequentially dropped into and accommodated by the adjacent receiving shelves 5A.

Figure 2:
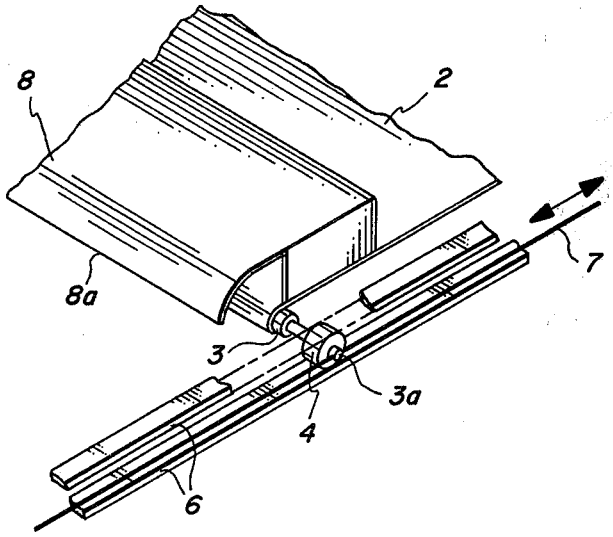
FIG. 2 is a partial perspective view of the sheet distributing device of FIG. 1.

When the end of the guide belt 2 is secured to the shaft 3 is moved leftwards as viewed in FIG. 2 the guide belt 2 is unwound or unreeled against the spring biasing of the roller 1 to lengthen the guide belt surface. As the shaft 3 is moved rightwards the guide belt 2 is shortened as it is taken up by the spring biased roller 1. The spring biasing maintains the guide belt in good tension.

Therefore, in accordance with this invention a very simple distribution and guiding arrangement is provided wherein a belt coiled upon a take-up roll is utilized for distributing sheets sequentially into an array of sheet receiving shelves. One end of the guide belt is sequentially advanced from bin entrance opening to bin entrance opening to sequentially distribute the sheets into the respective shelves. As the end of the belt is sequentially advanced the belt is also sequentially lengthened by being unwound from the take-up roll. After the desired number of shelves have been filled, the distributing end of the guide belt is reciprocated to its starting position and the guide belt is shortened by being rewound upon the take up roller.

The system of this invention is extremely simple and requires few mechanical parts. With the construction of the present invention as described above sheets, may be distributed into and accommodated by the receiving shelves without the use of guide rollers and guide pawls. Therefore, it will be appreciated that the entire device may be made smaller and simpler to reduce the causes of sorting failures and also to reduce the noise of the apparatus.

What is claimed is:

1. In a sheet distribution apparatus for distributing sheets discharged from a reproducing machine, including: a sheet receiving body having a plurality of sheet receiving shelves which define a plurality of entrance openings and means for sequentially distributing sheets into said shelves, the improvement wherein said distribution comprises:

a guide belt arranged between a position at which sheets are received for distribution and said sheet receiving body, said guide belt guiding said sheets into said sheet receiving shelves;

means for coiling up said guide belt, said coiling means comprising a take up roller arranged adjacent said position, one end of said guide belt being secured to said take-up roller; and means for sequentially advancing the other end of said guide belt along said sheet receiving body adjacent said entrance openings to sequentially distribute said sheets into said shelves.

2. An apparatus as in claim 1, wherein said sheet receiving shelves are arranged in a horizontal array and wherein said shelves are parallel to one another.

3. An apparatus as in claim 2, further including guide rails arranged at each side of said receiving body adjacent said entrance openings, a shaft secured to said other end of said guide belt, and means for supporting said shaft for movement along said guide rails.

4. An apparatus as in claim 3, furhter including a guide plate including a curved guide surface positioned above said other end of said guide belt for guiding sheets into said shelves.

5. An apparatus as in claim 1, wherein said guide belt has a low friction surface to permit easy sliding of said sheets.

6. An apparatus as in claim 5, wherein said low friction surface comprises Teflon.

* * * * *